United States Patent [19]

Uetsuhara et al.

[11] Patent Number: 4,905,121

[45] Date of Patent: Feb. 27, 1990

[54] OPERATION CONFIRMING DEVICE FOR ELECTROMAGNETIC ACTUATOR

[75] Inventors: Tokio Uetsuhara, Urawa; Kenji Iio, Kurate, both of Japan

[73] Assignee: Mitsubishi Mining & Cement Co., Ltd., Tokyo, Japan

[21] Appl. No.: 66,745

[22] PCT Filed: Oct. 8, 1986

[86] PCT No.: PCT/JP86/00513

§ 371 Date: May 27, 1987

§ 102(e) Date: May 27, 1987

[87] PCT Pub. No.: WO87/02506

PCT Pub. Date: Apr. 23, 1987

[30] Foreign Application Priority Data

Nov. 10, 1985 [JP] Japan ..... 60-226347

[51] Int. Cl.[4] ..... H01F 7/08

[52] U.S. Cl. ..... 361/159; 361/187

[58] Field of Search ..... 335/234; 361/159, 187

[56] References Cited

U.S. PATENT DOCUMENTS 4,321,570 3/1982 Tsunefuji ..... 335/234

FOREIGN PATENT DOCUMENTS 48-22609 7/1973 Japan .
53-55623 5/1978 Japan .
53-53023 12/1978 Japan .
53-53024 12/1978 Japan .

OTHER PUBLICATIONS

Green, R. C. et al., "Pick-Time Detector for Typewriter Magnets," IBM Technical Disclosure Bulletin, vol. 21, No. 3 (Aug. 1978) pp. 1109–1110.

*Primary Examiner*—L. T. Hix
*Assistant Examiner*—David M. Gray
*Attorney, Agent, or Firm*—Bierman and Muserlian

[57] ABSTRACT

An operation confirming device for electromagnetic actuator according to the present invention is applied to an electromagnetic actuator comprising a stationary core, a movable core facingly arranged with respect to the stationary core so that the movable core can be moved close to or apart from the stationary core and formed in a closed magnetic circuit together with the stationary core, and an electric coil wound around the closed magnetic circuit. This operation confirming device is provided with a movable core shift detector for detecting time when shift operation of the movable core with respect to the stationary core by applying DC current to the electric coil is completed, by means of transitional fluctuating wave of the applied DC current. This operation confirming device is simply constructed, so that it can be formed in a compact size and a light weight with low manufacturing cost, and the reliability of operation confirming for electromagnetic actuator can be improved.

1 Claim, 3 Drawing Sheets

OPERATION CONFIRMING DEVICE FOR ELECTROMAGNETIC ACTUATOR

FIELD OF TECHNICAL ART

The present invention generally relates to an operation confirming device for electromagnetic actuator which can electrically confirm mechanical shift of a movable core of the electromagnetic actuator or of mechanism connected to the movable core caused by applying electric energy to the electromagnetic actuator.

BACKGROUND TECHNIQUE

A conventional device for confirming shift operation of a movable core of electromagnetic actuator has commonly employed an electric point mechanically connected to a movable core of the actuator. However, such conventional device has essentially provided following demerits or problems.

(1) Mechanism for connecting between the electromagnetic actuator and the electric point is complicated.

(2) The electric contact point has inherent demerits; that is, treatments for water proof, dust proof, moisture proof are complicated, and a lifetime of this electric contact point on account of influence of contact repetition should be considered.

(3) Switching operation of this electric contact point is checked through an electric signal, so that an extra power source and an electric wire for transmitting such signal are additionally required.

(4) The above mentioned problems make the manufacturing cost of this electromagnetic actuator increase.

DESCRIPTION OF THE INVENTION

Therefore, the present invention has been proposed in order to overcome the above mentioned problems. It is an object of the present invention to provide an operation confirming device for electromagnetic actuator, whose construction is simple and durable with low manufacturing cost.

To accomplish the above mentioned object, the operation confirming device for electromagnetic actuator, which is adapted to the electromagnetic actuator comprising a stationary core, a movable core facingly arranged with respect to the stationary core so that the movable core can be moved close to or apart from the stationary core and formed in a closed magnetic circuit together with the stationary core, and an electric coil wound around the closed magnetic circuit; is characterized that the operation confirming device is provided with a movable core shift detector for detecting time when shift operation of the movable core with respect to the stationary core by applying DC current to the electric coil is completed, by means of transitional fluctuating wave of the applied DC current.

The present invention can provide the following effects and thus will avail to various industries and private uses.

(1) The device can remove contact point, so that the reliability of operation confirming for electromagnetic actuator can remarkably improved.

(2) The mechanism or device attached to electromagnetic actuator for operation confirming can be simplified, and thus the whole structure of the device will become simple.

(3) The electric wire for electric signal to perform the confirming operation, always required in the conventional devices, can be eliminated by arranging the movable core shift detector at an operating wire for controlling the electromagnetic actuator near by the power source. Therefore, the present invention can be broadly used for a remote controlled electromagnetic actuator to provide excellent economic advantages.

(4) The present invention can contribute to decrease the size, weight and cost of the operation confirming device for electromagnetic actuator, and to improve reliability thereof.

THE BEST MODE FOR EMBODYING THE PRESENT INVENTION

Hereinbelow, the present invention will be explained in conjunction with the accompanying drawings.

Figure 1:
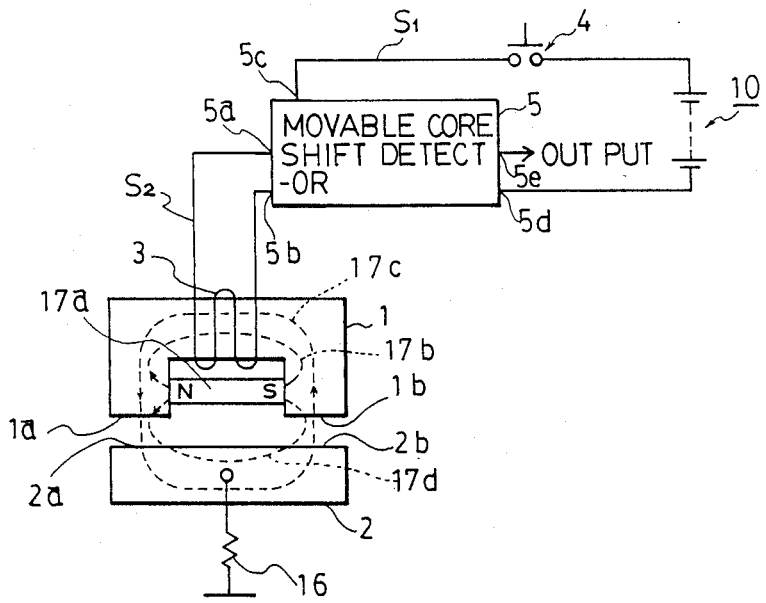
FIG. 1 is a schematic illustration for explaining the first embodiment of the present invention.

FIG. 1 shows the first embodiment of the present invention. In the drawing, the reference numeral 1 denotes a stationary core containing magnetic pole faces 1*a* and 1*b*. The reference numeral 2 denotes a movable core 2 containing magnetic pole faces 2*a* and 2*b*. The cores 1 and 2 are so arranged that their opposite faces can be moved close to and apart from each other through gaps.

An electric coil 3 is wound around the stationary core 1 to energize a closed magnetic circuit composed of the stationary core 1 and the movable core 2 when the electric coil 3 is supplied with electric current.

A permanent magnet 17*a* is fixed to the stationary core 1. In the closed magnetic circuit consisting of the stationary core 1 and the movable core 2, this permanent magnet 17*a* is intended to generate the second magnetic fluxes 17*b* and 17*d* which dividingly flow in parallel to the first magnetic flux 17*c* generated when the electric coil 3 is energized.

The reference numeral 4 denotes a switch for turning on or off a DC power source 10.

A spring 16 is so arranged as to apply mechanical urging force to the movable core 2 to maintain a predetermined distance between the magnetic pole faces 1*a* and 1*b* of the stationary core 1 and the magnetic pole faces 2*a* and 2*b* of the movale core 2.

The reference numeral 5 denotes a movable core shift detector. The movable core 2 is forcibly shifted toward the stationary core 1 while DC current is supplied to the electric coil 3. Thus the detector 5 detects the time when this shift operation is completed, by means of transitional fluctuating wave of the applied DC current.

Figure 2:
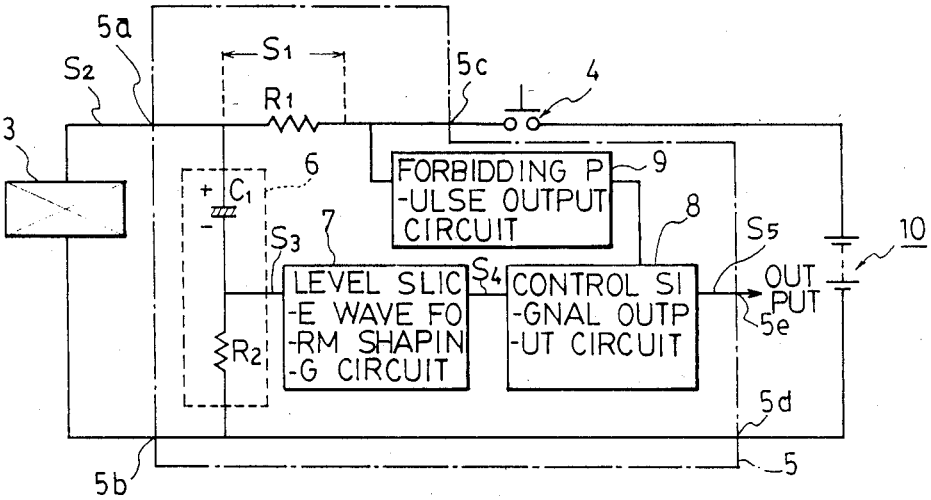
FIG. 2 is a circuit diagram showing the composition of the movable core shift detector which is a component of the first embodiment shown in FIG. 1.

Hereinbelow, the movable core shift detector 5 will be explained in detail about its composition in conjunction with FIG. 2.

The positive terminal of the DC power source 10 is connected to one end of the switch 4. The other end of the switch 4 is connected to a terminal 5*c* of the movable core shift detector 5 and finally connected to the negative terminal of the DC power source 10 via a series connected circuit composed of a resistor R1, a capacitor C1, and a resistor R2. This resistor R1 is adapted for detecting current wave-form. The series connected circuit composed of the capacitor Cl and the resistor R2 functions as a differential circuit 6.

One end of the electric coil 3 is connected to the junction between the resistor R1 and the capacitor C1 through a terminal 5*a* of the movable core shift detector 5. The other end of the electric coil 3 is connected to the negative terminal of the DC power source 10 through terminals 5*b* and 5*d* of the movable core shift detector 5.

The junction between the capacitor C1 and the resistor R2; they compose the differential circuit 6, is connected to a sequence control device, not shown, through a level slice wave form shaping circuit 7, a control signal output circuit 8 and an output terminal 5*e* of the movable core shift detector 5. The other end of the switch 4 is further connected to the control signal output circuit 8 through the terminal 5*c* and a forbidding pulse output sircuit 9.

Figure 3:
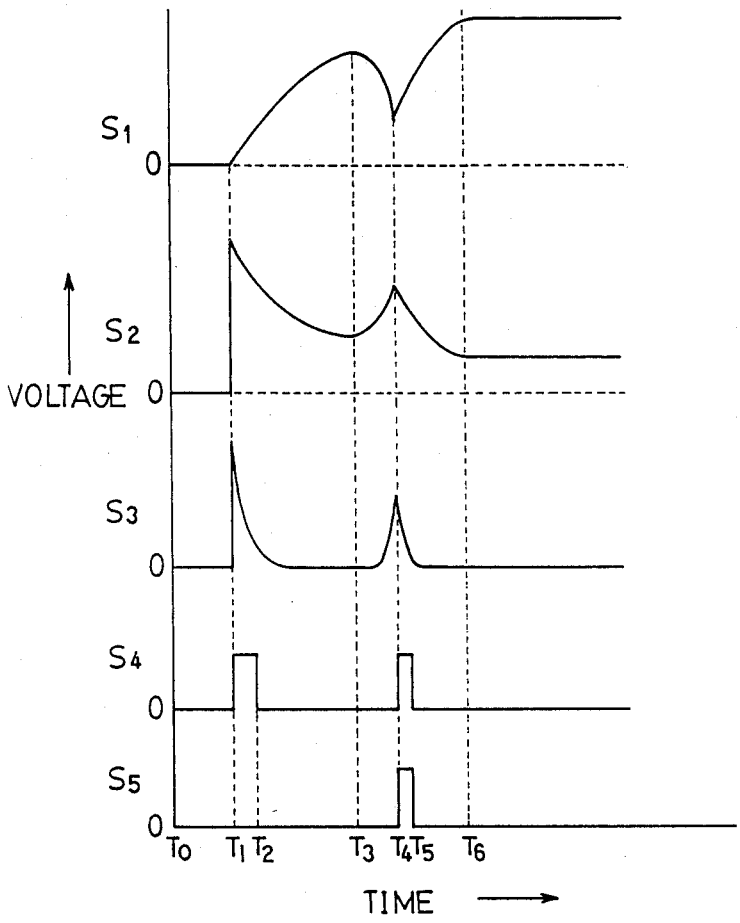
FIG. 3 is a graph showing various signal waves generated by the device of first embodiment shown in FIG. 1.

Nextly, an operation of this embodiment will be explained in conjunction with the wave forms shown in FIG. 3.

When the switch 4 is kept in off position and the electric coil 3 is not energized, the predetermined distance is also kept between respective pairs of the magnetic pole faces 1*a* and 2*a* and 1*b* and 2*b* of the stationary core 1 and the movable core 2, faced each other as shown in FIG. 1 on account of the mechanical urging force of the spring 16. Under this condition, if the switch 4 is turned on at the time T1, the falling voltage S1 of the resistor R1 will rise as like as an exponential function and arrive at the peak at the time T3 as shown in FIG. 3. Then, it will fall to predetermined value at the time T4 and change to rising in an exponential function curve, again. Finally, it will arrive at its saturated position at the time T6.

In this curve, the time T3 corresponds to the shift begining time of the movable core 2, and the time T4 corresponds to the shift finishing time; that is, respective pairs of the magnetic pole faces of the stationary core 1 and the movable core 2 are contacted.

The sum of the applied voltage S2 to the electric coil 3 and the falling voltage S1 of the resistor R1 is equivalent to the voltage of the DC power source 10. The wave form of the applied voltage S2 has two peaks at the times T1 and T4.

This DC current voltage S2 is input to the differential circuit 6 which is a component of the movable core shift detector 5. Then the differential circuit 6 outputs a differential signal S3. This differential signal S3 is input to the level slice wave form shaping circuit 7, so that the shaped signal is output as a signal S4 which is a square wave pulse having a predetermined value at the time ranges from the time T1 to T2 and the time T4 to T5.

The forbidding pulse output circuit 9 supplies a signal to the control signal output circuit 8 so as to forbid the square wave pulse between the times T1 and T2 to rise. According to this forbidding, a signal S5 having the square wave pulse between the times T4 and T5 is supplied to the sequence control device not shown from the output terminal 5*e*. This square wave pulse between the times T4 and T5 is used to confirm the time when magnetic pole faces of the stationary core 1 and the movable core 2 have been contacted.

Nextly, the second embodiment of the present invention will be explained in conjunction with FIG. 4.

This embodiment relates to an electromagnetic actuator capable of latching, whose composition is almost similar to that of FIG. 1 except for a cylindrical stationary core 1 which has one opened end, a movable core 2 set in the stationary core 1, a permanent magnet 17 fit in the stationary core 1, and a cylindrical non-magnetic guide tube 18.

Figure 4:
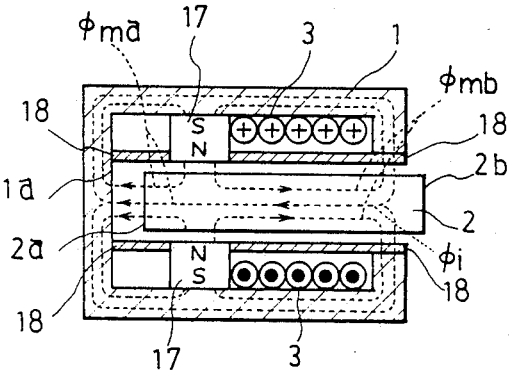
FIG. 4 is a schematic illustration showing the second embodiment which is adapted for a bistable latching operation.

Under the condition of the stationary core 1 and the movable core 2 shown in FIG. 4, the second magnetic flux generated by the permanent magnet 17 is divided into magnetic flux flows $\phi$ma and $\phi$mb represented by the dotted line shown in the drawing. Thus if the DC current voltage S2 applied to the electric coil 3 has the polarity as shown in the figure, the magnetic flux flows caused by the permanent magnet 17 will be overlapped with the first magnetic flux $\phi$i caused by the electric coil 3 during being energized. Accordingly, the movable core 2 is shifted into the contact state between the magnetic faces 1*a* and 2*a*.

Under this contact state, if the electric coil 3 is supplied with the current with the reverse polarity of that shown in the figure, the magnetic faces 1*a* and 2*a* will be returned to its separate state as shown in the figure. Owing to the existance of the magnetic flux $\phi$ma or $\phi$mb, the falling voltage S1 at the time T4 shown in FIG. 3 will be extremely remarkable, so that it can be easily confirmed.

Although the electromagnetic actuators according to the first and second embodiments contain the permanent magnet 17*a* or 17 inserted therein, the electromagnetic actuators according to the present invention are not limited to only these structures.

USE-ABILITY IN INDUSTRIAL FIELD

The present invention can be used as an operation confirming means for electromagnetic actuator without a contact point, which has the high reliability and economical merit in various industrial fields and private uses.

We claim:

1. An electromagnetic actuator consisting essentially of a stationary core, a movable core facingly arranged with respect to the stationary core so that the movable core can be moved close to or apart from the stationary core and formed in a closed magnetic circuit together with the stationary core, and an electric coil wound around the closed magnetic circuit, an operation confirming device for the electromagnetic actuator comprising a movable core shift detector for detecting time when shift operation of the movable core with respect to the stationary core by applying DC current to the electric coil is completed by means of transitional fluctuating wave of the applied DC current, the electromagnetic actuator further comprising a permanent magnet fixed to the stationary core to generate a second magnetic flux arranged parallel to the first magnetic flux generated when the electric coil is supplied with electric current in the closed magnetic circuit comprised of the stationary core and the movable core.

* * * * *